United States Patent [19]

Abboud

[11] Patent Number: 4,913,321

[45] Date of Patent: Apr. 3, 1990

[54] BULK PARTICULATE SOLIDS TRANSPORT BAG WITH GAS ASSIST UNLOADING FEATURE

[76] Inventor: Harry Abboud, 5845 Clematis Dr., Baton Rouge, La. 70808

[21] Appl. No.: 229,820

[22] Filed: Aug. 8, 1988

[51] Int. Cl.[4] ..... B65G 69/06

[52] U.S. Cl. ..... 222/195; 222/105

[58] Field of Search ..... 222/92, 94–95, 222/105, 107, 630, 185, 195, 181

[56] References Cited

U.S. PATENT DOCUMENTS

| | | | |
|---|---|---|---|
| 2,665,035 | 1/1954 | Schemm | 222/195 |
| 2,829,803 | 4/1958 | Paton | 222/95 |
| 3,170,600 | 2/1965 | Pierson | 222/195 X |
| 3,201,000 | 8/1965 | Hermanns | 222/195 X |
| 3,669,317 | 6/1972 | Ivchenko et al. | 222/195 |
| 4,167,235 | 9/1979 | Green | 222/105 |

FOREIGN PATENT DOCUMENTS

| | | | |
|---|---|---|---|
| 2161631 | 6/1973 | Fed. Rep. of Germany | 222/195 |
| 7602666 | 9/1976 | Netherlands | 222/195 |

*Primary Examiner*—Michael S. Huppert

*Attorney, Agent, or Firm*—Llewellyn A. Proctor

[57] ABSTRACT

A particulate solids transport bag with a gas assist unloading feature. The bag is one having an enclosing flexible side wall, or walls, flexible bottom wall provided with an opening, preferably a spout, and a gas distributor. The gas distributor is of tubular shape formed by a flexible material located atop or upon, around or surrounding said bottom wall opening, or spout, and contains a gas permeable upper face, gas impervious lower face and gas inlet into the tubular space. Gas, particularly air, is injected via the inlet into the tubular opening and passed through the gas permeable upper face of the flexible material to aerate and render the solids flowable for discharge through the opening, or spout, of the bottom wall.

10 Claims, 3 Drawing Sheets

BULK PARTICULATE SOLIDS TRANSPORT BAG WITH GAS ASSIST UNLOADING FEATURE

FIELD OF THE INVENTION

This invention relates to improvements in large fabric bags of the type used to transport bulk quantities of particulate solids. In particular, it relates to bulk fabric bags provided with gas assist means to facilitate and increase the rate of removal of the particulate solids from the bags.

BACKGROUND OF THE INVENTION

Bulk particulate solids in the form of powders or granules are commonly loaded into large fabric bags and the loaded bags, expanded by the solids, are transported by truck or rail from a manufacturer to an end user. Typically, the bags are expanded on loading from the top, and a bottom spout is opened for discharge of the particulate solids while the bag is lifted and, often shaken, to aid the flow of particulate solids through the spout. Ideally, after discharge of the solids the bag is then reused in the same service.

The time required to unload these bags is typically slow, and often the solids cannot be discharged without ripping open the bags; because the particulate solids fail to flow through the spout. For example to unload 24 bags each of which contains one ton of adsorbent clay requires at least 4 hours, and often 6 hours. The bottom of some of the bags are often ripped open to remove the solids because solids flow from the bottom spout ceases, or cannot be initiated. The time required for emptying these bags burdens the process in which the particulate solids are used; and when a bag is ripped open it is destroyed. This is costly, particularly when the bag cannot thereafter be reused.

Some fabric bags in their design do not include a bottom spout, and these bags are always destroyed when they are ripped open to empty the bag of its contents. This type of bag is disclosed, e.g., in U.S. 4,307,764. Flexible bags provided with bottom spouts through which particulate solids can be removed via gas assist means are described e.g., by U.S. Pat. No. 2,829,803 and U.S. Pat. No. 4,167,235. In the former patent, a suction tube is provided in the bottom of the bag, and in the latter a blower located at the bottom of a vented bag is coupled to a transfer chute containing an air inlet, for the removal of solids from the bags. Whereas it has been recognized that gas assist means for the removal of solids from the bags may be helpful, presently known devices are expensive, complex, and less effective than desired. There exists a pressing need for fabric bags which can be more rapidly emptied of particulate solids, particularly fabric bags with bottom openings through which the solids can be more rapidly discharged without any necessity for destruction of the bags.

OBJECTS

It is, accordingly, the primary object of this invention to supply this need.

A particular object is to provide a flexible bag, notably a fabric bag, provided with novel gas assist means for emptying particulate solids loaded therein.

A further, and more particular object of this invention is to provide a flexible bag, especially a fabric bag, with flexible side and bottom walls into which particulate solids can be loaded and the bag expanded, a bottom opening, or spout, and gas or air injection means incorporated therein to facilitate, on the injection of generally small amounts of gas or air into the bag, the flow of solids through the bottom opening, or spout, of the bag.

THE INVENTION

These objects and others are achieved in accordance with the present invention which embodies a bag having an enclosing flexible side wall, or walls, flexible bottom wall provided with an opening, preferably a spout, and a gas distribution means. The gas distribution means is formed by a flexible material located atop or upon around or surrounding said bottom wall opening, or spout, and contains a gas permeable upper face, gas impervious lower face and gas inlet into said tubular space. Gas, particularly air, is injected via the inlet into the tubular opening and passed through the gas permeable upper face of said flexible material to aerate and render the solids flowable for discharge through said opening, or spout, of said bottom wall.

In a preferred embodiment, the gas distribution means is an integral part of a gas impervious bottom wall, the gas permeable upper face of the tube being formed by sealing the edges of a gas permeable material, particularly a fabric, upon a gas impervious flexible material constituting the bottom wall, or floor, of the flexible bag. In another preferred embodiment, a permeable support medium, suitably a plurality of layers of a flexible open fabric is located between the inner lowr face of said upper gas permeable material and the upper face of said gas impervious material to provide an open staggered pillar-like structure which holds the gas permeable and gas impervious members apart, maintaining in effect a continuous network of lateral openings lying between the pillars such that gas can flow through the continuous network of passageways in all directions from the point of entry of the gas, or air, over the whole tubular volume. Consequently when the gas, e.g., air, is introduced via the gas inlet into the tubular opening, air will fill the entire volume of the tube via lateral flow, and will then flow outwardly over essentially the whole area of the gas permeable material to aerate the particulate solids.

The characteristics of a preferred apparatus, or bag, and its use, as well as its principle of operation, will be more fully understood by reference to the following detailed description, and to the attached drawings to which reference is made in the description. The various components in the drawings are referred to by numbers, similar features and components being represented in the different views by similar numbers. Subscripts are used with numbers where there are duplicate components, or to describe a component of a larger assembly.

Figure 6:
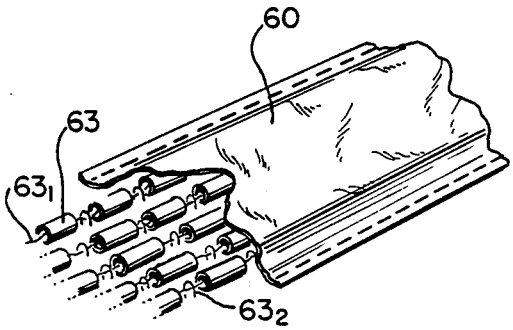
Figure 7:
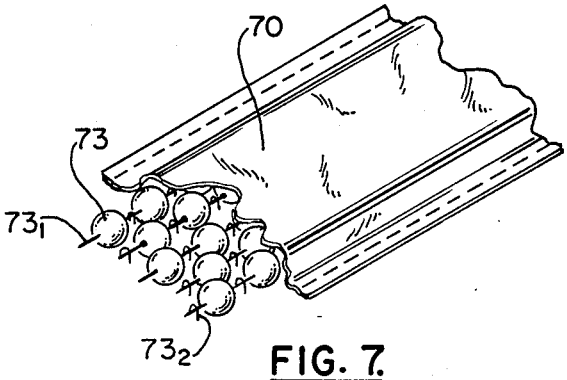

FIGS. 6 and 7 provide fragmentary views, in perspective, of other types of gas distribution components.

Figure 1:
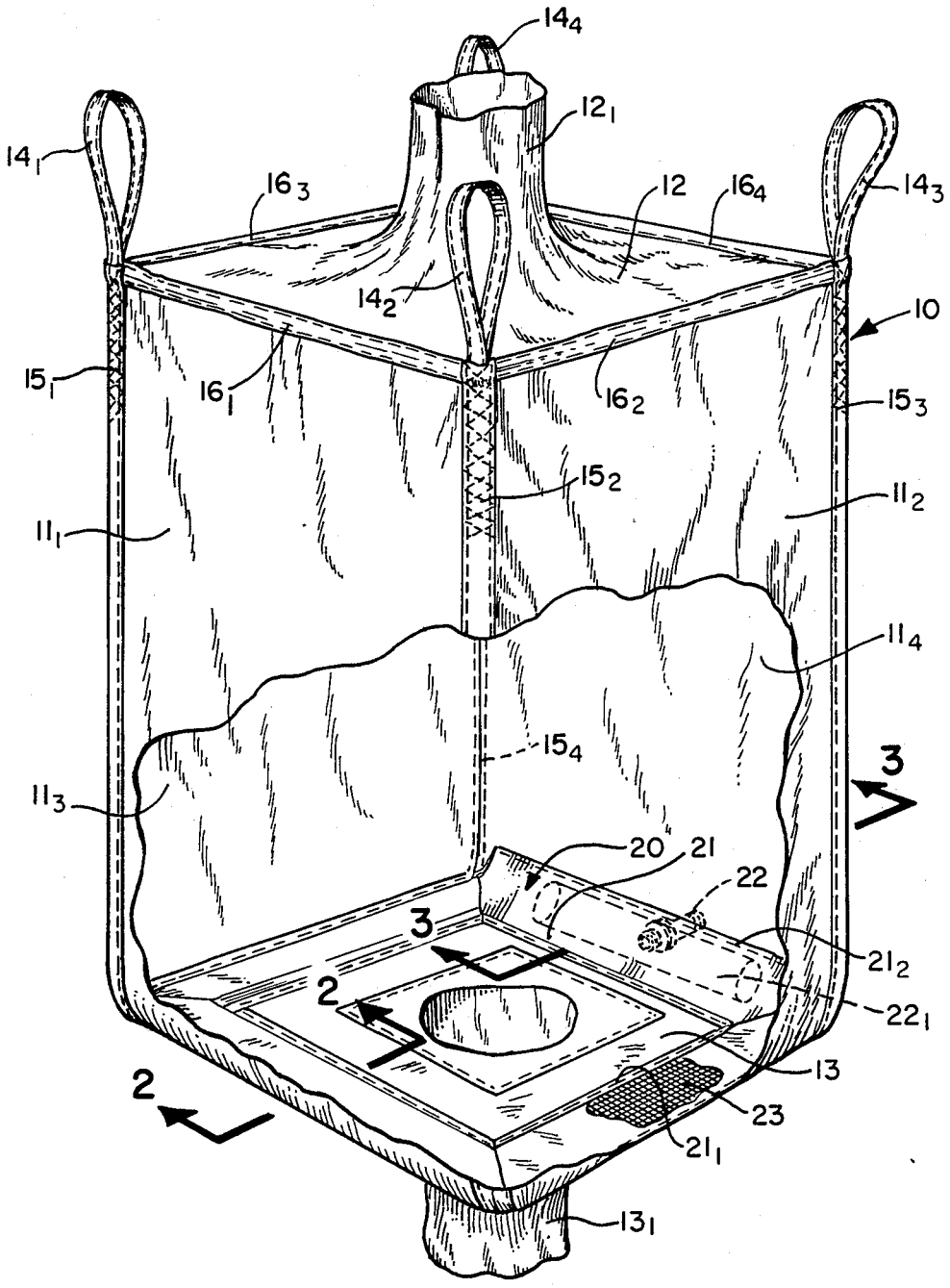
FIG. 1 depicts in perspective a fabric bag embodying a gas distribution means located upon the bottom wall, or floor, of the bag.
Figure 2:
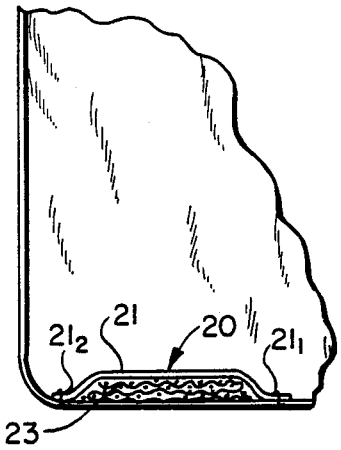
FIG. 2 is Section 2—2 taken from FIG. 1; a cross-section depicting the gas distribution means.
Figure 3:
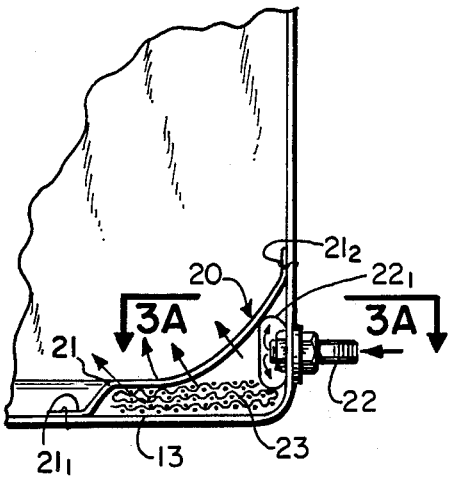
FIG. 3 is a Section 3—3 taken from FIG. 2; a cross-section depicting the gas distribution means; while FIG. A depicts a gas inlet feature of said FIG. 3.
Figure 4:
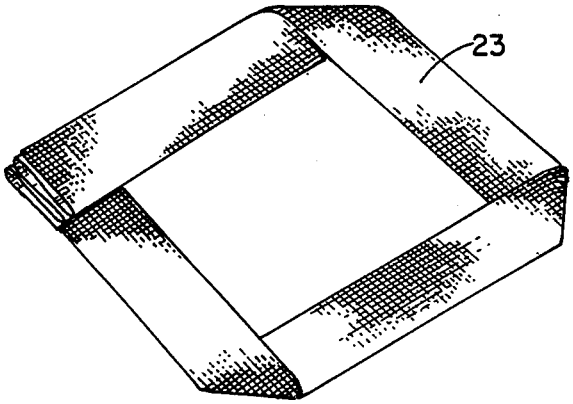
FIG. 4 depicts generally in perspective a fabric mesh employed in forming a component of the gas distribution medium.
Figure 8:
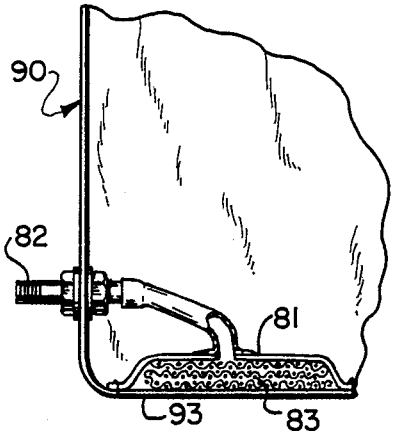

FIG. 8 depicts in fragmentary section a gas distribution medium as in FIGS. 1–3, but provided with an alternate type of gas inlet.

Figure 9:
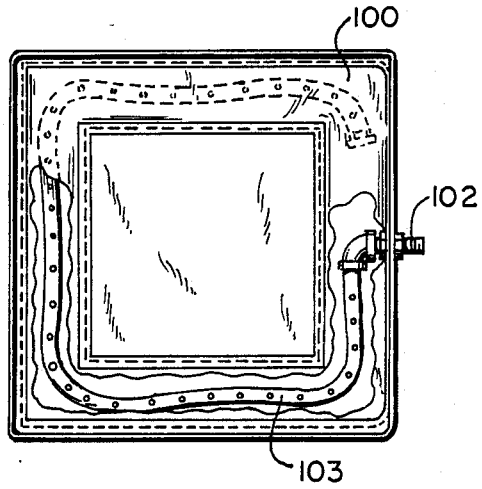

FIG. 9 depicts in fragmentary section, and in plan a gas distribution medium employing a gas distribution utilizing a perforated hose as a gas distribution component.

Referring to FIGS. 1–3, first to FIG. 1, there is shown a fabric bag 10 of substantially rectangular cross-section provided with side walls $11_1$, $11_2$, $11_3$, $11_4$, an upper or top wall 12 provided with a fill spout $12_1$, and a bottom wall, or floor 13 provided with a discharge spout $13_1$. Each of the walls is of rectangular shape, each is formed of a high tensile strength fabric, and each is essentially gas impervious. The four upper corners of the bag are provided with a lifting loop $14_1$, $14_2$, $14_3$, $14_4$ of strong fabric webbing affording a pair of legs joined to the fabric side walls and forming a bight portion.

Vertically extending means $15_1$, $15_2$, $15_3$, $15_4$ are formed at the four side wall corners, and extend the length of the bag. Horizontally extending seams $16_1$, $16_2$, $16_3$, $16_4$ and $17_1$, $17_2$, $17_3$, $17_4$, respectively, are formed at the four top and bottom walls, and extend horizontally around the circumference of the bag. The seams 17 are not visible in the drawing.

Figure 3A:
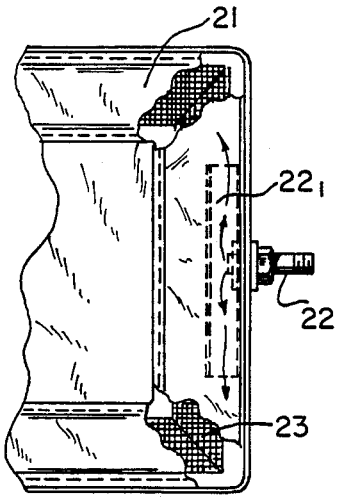

A gas distribution medium 20 of tubular cross-section is located at the bottom of the bag, and integral therewith. The gas distribution medium 20 is constituted of an upper gas permeable fabric 21 the edges $21_1$, $21_2$ of which are sealed and sewn to the bottom wall, or floor 13 of the bag. The gas permeable fabric 21, with the portion of the bottom wall 13 covered by the fabric 21, adjoined thereto, provides an enclosure or chamber of generally tubular shape to which gas, or air, can be admitted via a gas inlet 22, or plurality of inlets. It will be noted that gas introduced via inlet 22 is distributed into the tubular opening indirectly via a tubular guard member $22_1$ affixed upon the discharge end of the gas inlet 22, the gas inlet 22 being extended through a hole in the side of the bag; reinforced for addes strength (FIGS. 3 and 3A). Gas, or air, introduced via inlet 22 will thus be distributed laterally throughout the tubular opening, and will flow upwardly out of the tubular opening through the gas permeable fabric 21 to aerate particulate solids contained within the bag, and thus facilitate their flow and consequent discharge from the bag via the discharge spout $13_1$.

The tubular opening of the gas distribution medium preferably contains a plurality of layers of an open mesh woven or knit fabric 23, illustrated by reference to any of FIGS. 1–4. The layers of fabric 23 lie directly under and in direct contact with the gas permeable upper fabric 21 and atop and in direct contact with the portion of the wall 13 upon which the gas permeable fabric 21 is sealed to provide a staggered pillared support structure to separate and support the fabric 21 above the wall 13, as well as a network of channels to facilitate lateral distribution of the gas throughout the tubular gas distribution medium. Suitably, the layers of fabric 23 are each constituted of an open network of plastic monfilaments spaced apart and parallelly and horizontally aligned, the points of intersection being adequate to provide pillars which props open, or supports fabric 21 above the bottom wall 13, and around which is formed a flow path of communicating lateral channels.

Figure 5:
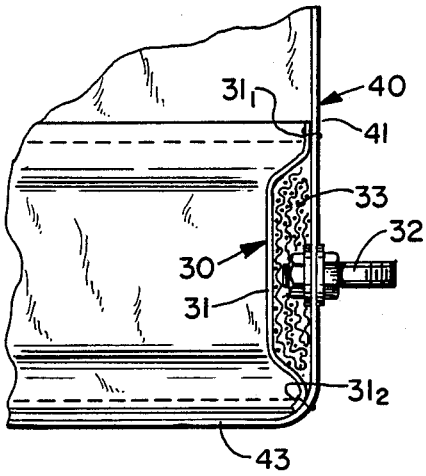
FIG. 5 depicts in fragmentary cross-section a gas distribution medium loated essentially on the side wall of a fabric bag.

With reference to FIG. 5 there is shown a gas distribution means 30, generally similar to that described by reference to FIGS. 1–3, except that said gas distribution means 30 is integrally affixed on the lower side wall 41 of a fabric bag 40 rather than on the bottom wall, or floor 43 of the bag. Gas, or air, introduced via gas inlet 32 into the tubular chamber passes through the gas distribution medium 33 and flows laterally throughout said tubular chamber, exiting therefrom via gas permeable fabric 31, sealed at its edges $31_1$, $31_2$ to form the chamber.

The gas distribution means 60 and 70, described by reference to FIGS. 6 and 7, respectively, are constructed in similar manner to gas distribution means 20, 30 previously described; and can be integrated into the lower side wall or bottom wall of a fabric bag. In gas distribution means 60 the gas distribution medium is constituted of a series of tubular elements 63, spaced apart, in line one with another, held in place by means of a line or thread $63_1$ passed through the tubular axis thereof, and secured via means of stitches or clamps $63_2$. In gas distribution means 70, beads 73 are serially alingned, spaced apart and secured in place via means of a line or thread $73_1$ passed through the bead openings, and stitches or clamps $73_2$.

The gas distribution means 80, described by reference to FIG. 8, is essentially similar to the device of FIGS. 1–3 except that in this instance the gas inlet 82 enters through the side wall of the fabric bag, and is adjoined to an opening in the upper face of the gas permeable fabric 81 sealed via its edges $81_1$, $81_2$ to the bottom wall 83 of the bag 90. Air passed via gas inlet 82 enters into the tubular passageway containing the gas distribution medium 83 which rests on top of the bottom wall 93 of bag 90. Gas exits the tubular member via gas permeable fabric 81.

Referring to FIG. 9 there is described a gas distribution means 100 generally similar to that described by reference to FIG. 6 except that the gas distribution medium 103 is constituted of a hose which is perforated from one end to the other. Gas entering into the gas inlet 102 is passed laterally the length of the hose, the terminal end of which is plugged, exiting therefrom via the plurality of perforations located throughout the length of the hose. Gas exiting from the perforations is passed via the gas permeable fabric into the bag to aerate the particulate solids.

It is apparent that various modifications and changes can be made without departing the spirit and scope of the invention. For example, the bag may be of round or parallelogram cross-section, the side wall can be formed of one or several panels, the gas distribution medium can be an integral part of the flexible bag, or separate therefrom, and the bag can be constituted of a variety of shapes and sizes of any of a number of high tensile strength flexible materials, to wit: polypropylene, rayon, nylon, polyvinylchloride, jute and the like.

Having described the invention, what is claimed is:

1. In a flexible, fabric bag for transporting bulk particulate solids having gas impervious side and bottom walls, the bottom wall of which is provided with a discharge spout which can be opened for discharging particulate solids loaded therein, and the bag is expanded by said particulate solids and collapsed by discharge of said particulate solids, the improvement comprising a gas distribution means of tubular shape providing a lateral passageway through which gas can be passed formed by a flexible material surrounding said particulate solids discharge spout, said distribution means contains a gas permeable upper face, gas impervious lower face, and a gas inlet into said tubular passageway, such that gas injected via said gas inlet into said tubular passageway and through said gas permeable upper face will aerate and render the particulate solids flowable for discharge through said discharge spout.

2. The bag of claim 1 wherein the gas distribution means of tubular shape constituting the gas permeable upper face of the gas permeable fabric is a gas permeable fabric sealed via its edges to the upper face of the bottom wall of the bag, the bottom wall of the bag to which the gas permeable fabric is sealed constituting the gas impervious lower face.

3. The bag of claim 1 wherein the gas distribution means of tubular shape is a gas permeable fabric sealed via its edges to the upper face of the lower side wall of the bag, the side wall of the bag to which the gas permeable fabric is sealed constituting the gas impervious lower face.

4. In a bag for transporting bulk particulate solids having gas impervious side and bottom walls, the bottom wall of which is provided with a discharge spout which can be opened for discharging particulate solids loaded therein and the bag is expanded by said particulate solids, the improvement comprising a gas distribution means of tubular shape providing a lateral passageway through which gas can be passed formed by a flexible material surrounding said particulate solids discharge spout, said distribution means contains a gas permeable upper face, gas impervious lower face, a permeable support medium comprised of an open pillar-like structure located between the gas permeable and gas impervious members which props these members apart, and maintains a continuous network of lateral openings between the pillars, and a gas inlet into said tubular passageway so that gas can be injected via said gas inlet into said tubular passageway such that the gas will flow therethrough in all directions, and upwardly through said gas permeable member to aerate and render the particulate solids flowable for discharge through said discharge spout.

5. The bag of claim 4 wherein the permeable support medium is constituted of a plurality of layers of a flexible open fabric.

6. The bag of claim 5 wherein the fabric is woven or knitted from plastic monofilaments.

7. The bag of claim 4 wherein the open pillar-like structure which props the gas permeable and gas impervious members apart, and maintains a continuous network of lateral openings between the pillars so that gas can flow therethrough in all directions, and upwardly through said gas permeable member to aerate the solids constituting the permeable support medium is a series of tubular elements, in-line and separated one from another and held together by a line passed through the tubular openings of each.

8. The bag of claim 4 wherein the permeable support medium is constituted of a series of beads, in-line and separated one from another and held together by a line passed through the bead openings.

9. The bag of claim 4 wherein the permeable support medium is constituted of a perforated hose.

10. The bag of claim 1 wherein the gas inlet enters directly into the tubular passageway of the gas distribution means after passage through the side wall of the bag.

* * * * *